US009259087B1

(12) United States Patent
Hsiao

(10) Patent No.: US 9,259,087 B1
(45) Date of Patent: Feb. 16, 2016

(54) FRONT CONNECTING DEVICE OF CONCEALED SLIDE

(71) Applicant: Sun Chain Trading Co., Ltd., Taipei (TW)

(72) Inventor: Ching-Lang Hsiao, Taipei (TW)

(73) Assignee: Sun Chain Trading Co., Ltd., Taipei (TW)

( * ) Notice: Subject to any disclaimer, the term of this patent is extended or adjusted under 35 U.S.C. 154(b) by 0 days.

(21) Appl. No.: 14/586,918

(22) Filed: Dec. 30, 2014

(30) Foreign Application Priority Data

Nov. 28, 2014 (TW) ..... 103221140 U

(51) Int. Cl.
*A47B 88/00* (2006.01)

(52) U.S. Cl.
CPC ..... *A47B 88/0055* (2013.01); *A47B 2088/0074* (2013.01); *A47B 2210/09* (2013.01)

(58) Field of Classification Search
CPC ..... A47B 2210/0054; A47B 2210/0056; A47B 88/0422; A47B 88/0433; A47B 88/0437; A47B 88/0055; A47B 2210/09; A47B 2088/0074
See application file for complete search history.

(56) References Cited

U.S. PATENT DOCUMENTS 5,439,283 A * 8/1995 Schroder ..... A47B 88/0407 312/334.38
5,580,139 A * 12/1996 Grabher ..... A47B 88/0422 312/333
5,730,514 A 3/1998 Hashemi
7,533,946 B2 5/2009 Hoffman
7,549,712 B2 * 6/2009 Booker ..... A47B 88/0422 312/333
8,807,672 B2 * 8/2014 Gasser ..... A47B 88/16 312/333
8,854,769 B1 * 10/2014 Liang ..... A47B 88/0422 360/125.51
8,979,223 B2 * 3/2015 Huang ..... A47B 88/0422 312/334.4
9,060,604 B2 * 6/2015 Salice ..... A47B 88/0422
9,066,587 B1 * 6/2015 Liang ..... A47B 88/0422
9,095,211 B2 * 8/2015 Amann ..... A47B 88/0422
9,101,213 B2 * 8/2015 McGregor ..... A47B 88/0407
2002/0158557 A1 * 10/2002 Weichelt ..... A47B 88/0422 312/334.4
2004/0095047 A1 * 5/2004 Salice ..... A47B 88/0422 312/332.1
2005/0231083 A1 10/2005 Garcie, Jr.
2009/0251037 A1 * 10/2009 Berger ..... A47B 88/0422 312/334.1
2012/0292465 A1 * 11/2012 Holzer ..... A47B 88/0422 248/201
2013/0113356 A1 * 5/2013 Salice ..... A47B 88/0422 312/334.44

(Continued)

FOREIGN PATENT DOCUMENTS

AT 510706 A4 6/2012
CN 101548821 4/2011

(Continued)

*Primary Examiner* — Hanh V Tran
(74) *Attorney, Agent, or Firm* — Leong C. Lei

(57) ABSTRACT

A front connecting device of a concealed slide includes a metal base, an elastic fastener, a level adjusting member and a vertical adjusting member. The metal base is mounted to a drawer, and the elastic fastener, the level adjusting member and the vertical adjusting member are movably installed to the metal base, and the elastic fastener is connected to an end of the concealed slide for adjusting a horizontal position and/or a vertical position of the concealed slide. The elastic fastener is integrally formed by plastic injection and includes a fastening portion, a handle, and an elastic portion disposed between the elastic fastener and the fastening portion. The handle may be pressed to deform the elastic portion and separate the fastening portion from the concealed slide. The device not only provides a convenient operation, but also lowers the manufacturing cost while maintaining the original functions.

5 Claims, 5 Drawing Sheets

(56) References Cited

U.S. PATENT DOCUMENTS

| | | | | |
|---|---|---|---|---|
| 2013/0249366 | A1* | 9/2013 | Gasser | A47B 88/0422 312/333 |
| 2013/0257244 | A1* | 10/2013 | Salice | A47B 88/0422 312/319.1 |
| 2013/0293077 | A1* | 11/2013 | Haemmerle | A47B 88/0422 312/319.1 |
| 2014/0015392 | A1* | 1/2014 | Salice | A47B 88/0422 312/334.44 |

FOREIGN PATENT DOCUMENTS

| | | | |
|---|---|---|---|
| TW | M448201 | | 3/2013 |
| TW | I404868 | | 8/2013 |
| WO | WO2004110213 | A2 | 12/2004 |

* cited by examiner

FRONT CONNECTING DEVICE OF CONCEALED SLIDE

CROSS-REFERENCE TO RELATED APPLICATIONS

This non-provisional application claims priority under 35 U.S.C. §119(a) on Patent Application No(s). 103221140 filed in Taiwan, R.O.C. on Nov. 28, 2014, the entire contents of which are hereby incorporated by reference.

BACKGROUND OF THE INVENTION

1. Field of the Invention

The present invention relates to the field of hardware components of furniture and cupboards, and more particularly to a front connecting device of a concealed slide applied to drawers of cupboards, and whose simplified structural design not just lowers the cost only, but also takes adjustments to the use into consideration.

2. Description of the Related Art

To save efforts and facilitate users to pull out a drawer of furniture such as filing cabinets, cupboards and tables, a pair of slides are generally installed between the drawer and the furniture for carrying the load of the drawer and sliding the drawer, and the slides are mainly divided into side-mounted and undermount slides, and the side-mounted slide is installed on a side of the drawer to connect the furniture, and the undermount slide (also known as concealed slide) is installed at the bottom of the drawer to connect the furniture to form a concealed mode, and thus such slide is called a concealed slide.

In general, the weight of a drawer presses at the concealed slide directly during use, so that the force exerting direction of the undermount slide is different from that of the side-mount slide, so that the structure of the concealed slide of the undermount slide is naturally different from that of the side-mounted slide. However, the gap between the drawer and the furniture cannot be adjusted due to the structural design of the side-mounted slide. On the other hand, the installation position and method of the concealed slide are different, so that when the vertical gap or horizontal gap between the drawer and the furniture varies, a front connecting device may be used for making adjustments.

Since there is always a tolerance between the drawer and the furniture to facilitate the installation, a bigger gap may be resulted in the process of manually installing, assembling, or producing the connecting device and the concealed slide due to different factors, or the gap may even exist between the concealed slide and the bottom of the drawer, not only giving an ugly look, but also may deviate the applied force since a panel is not situated at the center position. As a result, the front of the panel of the drawer may be tilted to a side, or the drawer may even not be opened easily. Now, the aforementioned front connecting device can be used for adjusting the relative positions of the concealed slide, the drawer and the furniture. Conventional front connecting devices are disclosed in R.O.C. Pat. No. M448201 entitled "Stepless drawer panel adjusting device", R.O.C. Pat. No. I404868 entitled "Auxiliary positioning device for slide assembly", U.S. Pat. No. 5,580,139 "Device for fixing a driver extension mechanism", U.S. Pat. No. 7,533,946 "Closing device for drawer", U.S. Pat. No. 5,730,514 entitled "Shock absorbing locking disconnect latch for ball bearing slides", U.S. Pat. Publication No. 20050231083 entitled "Undermount drawer slide", PCT Pat. Publication No. WO 2004/110213 entitled "Front locking device for releasably engaging a drawer to a drawer slide", Austrian Pat. No. 510706A4 entitled "KUPPLUNGSVORRICHTUNG FÜR SCHUBLADEN", and PRC Pat. No. 101548821 entitled "Slide adjusting device for drawers", and most of these front connecting devices have the drawbacks of complicated structure, difficult manufacture, and high manufacturing cost. In addition, the complicate structure of the front connecting device makes the maintenance and replacement difficult. Obviously, the conventional front connecting devices require improvements.

SUMMARY OF THE INVENTION

In view of the problems of the prior art, it is a primary objective of the present invention to provide a front connecting device of a concealed slide, wherein a metal sheet is used to make a metal base, and an elastic fastener, a level adjusting member, and a vertical adjusting member are formed by plastic injection, so as to simplify the structure significantly and lower the manufacturing cost, and achieve the effect of horizontally and vertically adjusting a gap between a drawer and the concealed slide intuitively and conveniently.

To achieve the aforementioned objective, the present invention provides a front connecting device of a concealed slide installed to an end of the concealed slide, and the other end of the front connecting device being fixed to a drawer for adjusting a horizontal gap and/or a vertical gap of the drawer, and the front connecting device comprises: a metal base, having a fixing portion formed at an end and fixed to the drawer, a horizontal socket portion and a vertical socket portion erected from the metal base, and a pivot hole formed on a side of the horizontal socket portion; an elastic fastener, having a main body made of an elastic plastic material, an elongated groove hole and a first pivot portion formed at an end of the elastic fastener, and the elastic fastener passing through the elongated groove hole and movably installed into the horizontal socket portion, and a fastening portion formed at an end of the elastic fastener and connected from a side and fixed to the concealed slide, a handle extended along a side of the fastening portion, and an elastic portion disposed between the main body and the fastening portion, such that the handle may be pressed to deform the elastic portion in order to separate the fastening portion from the concealed slide, and a positioning hook being installed to a side of the main body and provided for connecting the concealed slide; a level adjusting member, with the bottom movably installed into the pivot hole, and having a second pivot portion disposed at an end of the level adjusting member and configured corresponsive to the first pivot portion and provided for connecting the elastic fastener, and a lever installed at the other end of the level adjusting member, such that when the lever is adjusted, the concealed slide is aligned precisely opposite to a horizontal position of drawer; and a vertical adjusting member, movably installed to the vertical socket portion and capable of moving back and forth, and having a ramp formed at an end of the vertical adjusting member and configured to be corresponsive to the concealed slide, such that when the vertical adjusting member is adjusted, the concealed slide is aligned precisely opposite to a vertical position of the drawer.

In an embodiment, the metal base is formed by stamping a metal sheet, and the fixing portion is a vertically bent edge of the metal sheet and has at least two fixing holes, wherein at least two fixing holes are formed on the fixing portion for fixing the drawer. In addition, the vertical socket portion includes a limit notch, a serrated positioning plate and a limit hook, and the vertical adjusting member includes a positioning bump formed at a front end of the vertical adjusting member and configured to be corresponsive to the limit notch, a stopper member disposed at the center of the vertical adjusting member and configured to be corresponsive to the serrated positioning plate for positioning the vertical adjusting member at a position of the vertical socket portion, and a socket ring disposed at a rear end of the vertical adjusting member and configured corresponsive to the limit hook for improving the convenience of installation and making adjustment, and preventing the connecting device from being separated or falling apart during use.

In addition, the fastening portion is bent into a triangular shape, and an end of the fastening portion is not coupled to the elastic fastener. Since the fastening portion comes with an appropriate elasticity and a guiding bevel, therefore the fastening portion can be latched to the concealed slide securely, and the guiding bevel has a negative-angle design, so that the concealed slide will not be loosened or separated easily after it is latched.

DETAILED DESCRIPTION OF THE PREFERRED EMBODIMENTS

The technical content of the present invention will become apparent with the detailed description of preferred embodiments and the illustration of related drawings as follows.

Figure 1:
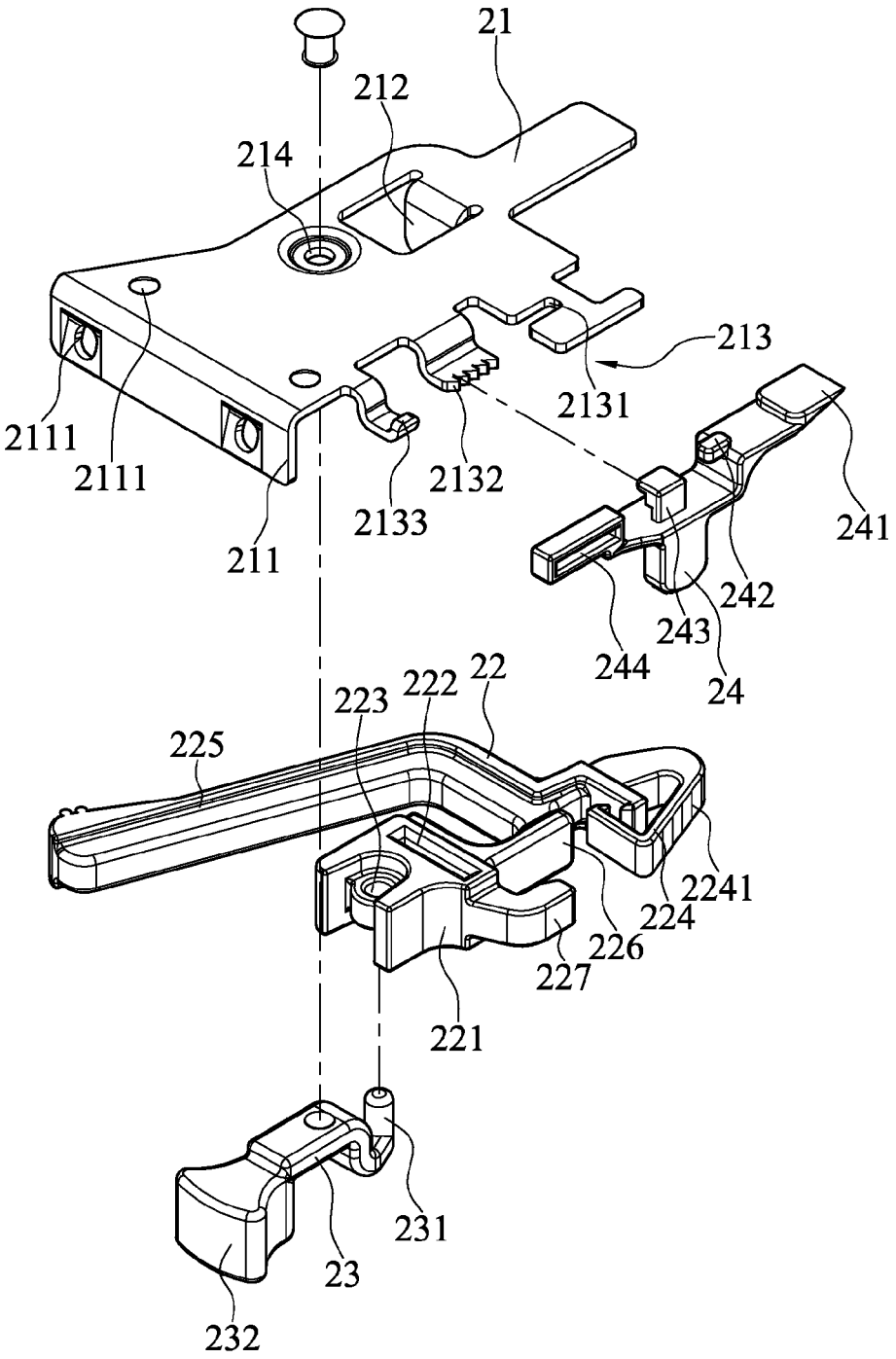
FIG. 1 is an exploded view of a preferred embodiment of the present invention.
Figure 2:
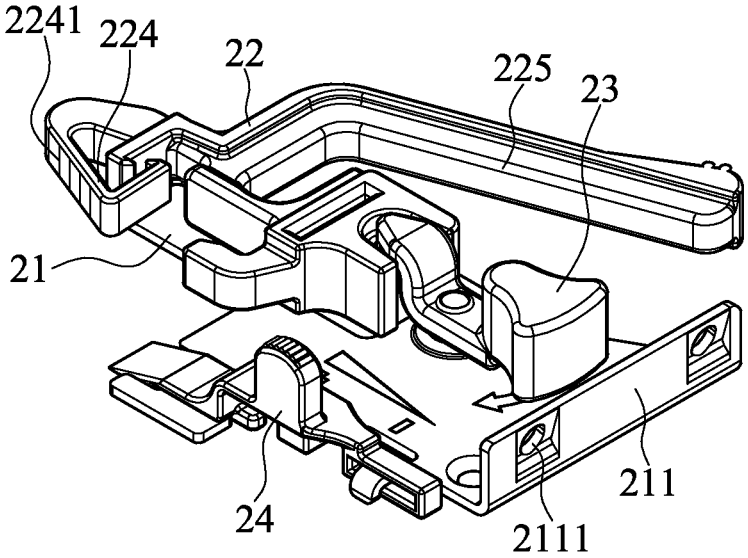
FIG. 2 is a schematic view of the configuration of a preferred embodiment of the present invention.
Figure 3:
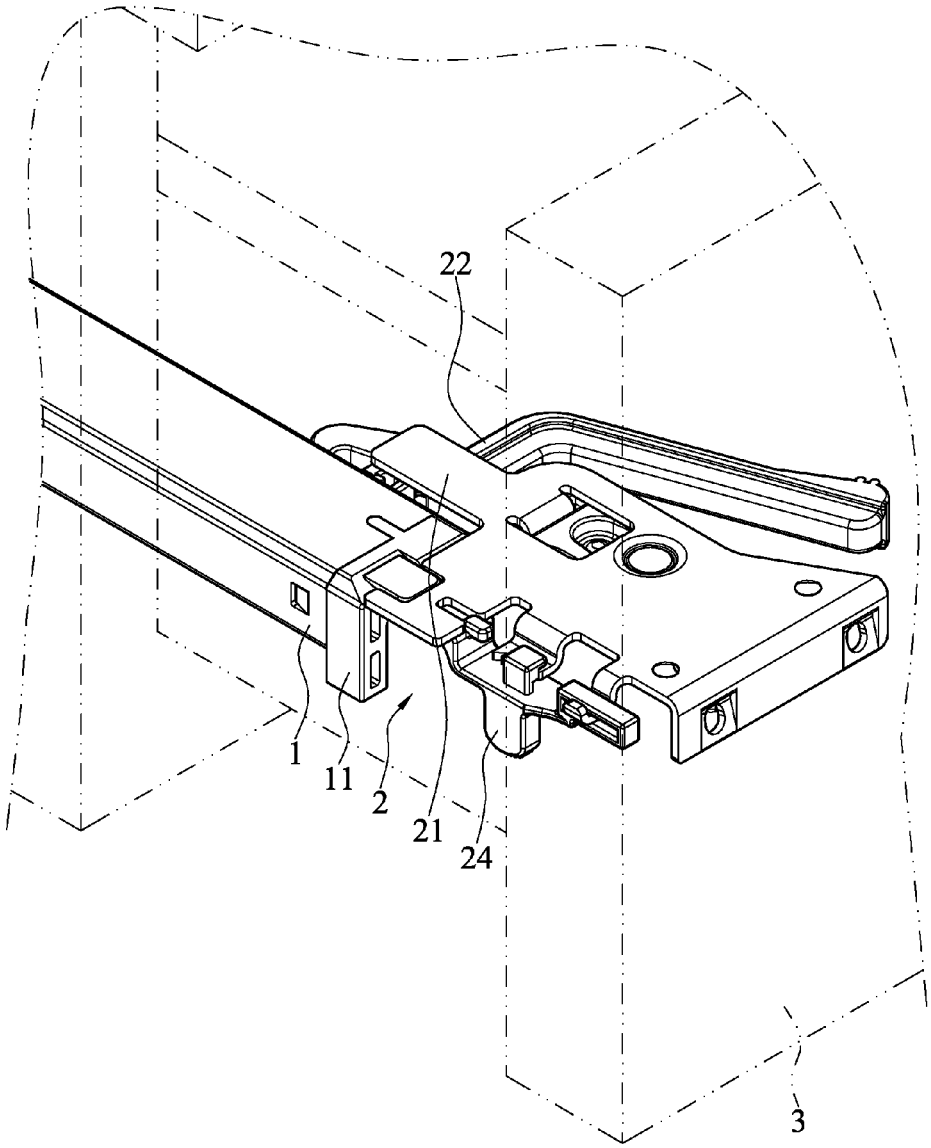
FIG. 3 is a schematic view of the status of combining a front connecting device to a concealed slide in accordance with a preferred embodiment of the present invention.

With reference to FIGS. 1, 2 and 3 for an exploded view of a front connecting device of a concealed slide, a schematic view of the configuration of the front connecting device of the concealed slide, and a schematic view of the status of combining the front connecting device to the concealed slide in accordance with a preferred embodiment of the present invention respectively, the front connecting device 2 of the concealed slide 1 is installed to an end of the concealed slide 1, and the other end of the front connecting device 2 is fixed to a drawer 3, for adjusting a horizontal gap and/or a vertical gap of the drawer 3, wherein a combining member 11 is installed to an end of the concealed slide 1. The front connecting device 2 comprises a metal base 21, an elastic fastener 22, a level adjusting member 23 and a vertical adjusting member 24.

Wherein, the metal base 21 is formed by stamping a metal sheet, and an end of the metal base 21 has a fixing portion 211 fixed to the drawer 3, and a side of the metal base 21 has a horizontal socket portion 212 and a vertical socket portion 213 disposed adjacent to each other, and a side of the horizontal socket portion 212 has a pivot hole 214 formed thereon. It is noteworthy that the fixing portion 211 is configured to be corresponsive to the drawer 2 and formed by vertically bending an edge of the metal sheet, and two fixing holes 2111 are formed on a surface of the fixing portion 211, and the vertical socket portion 2131 includes a limit notch 2131, a serrated positioning plate 2132 and a limit hook 2133, wherein the limit notch 2131, the serrated positioning plate 2132 and the limit hook 2133 are integrally formed on the metal base 21.

The elastic fastener 22 has a main body 221 made of an elastic plastic material, and an elongated groove hole 222 and a first pivot portion 223 formed at an end of the elastic fastener 22, and the elastic fastener 22 is passed through the elongated groove hole 222 and movably installed into the horizontal socket portion 212, wherein the elongated groove hole 222 has a width greater than the width of the horizontal socket portion 212, and an end of the elastic fastener 22 has a fastening portion 224 fixed to the concealed slide 1 from a side, and a handle 225 is extended along a side of the fastening portion 224, and an elastic portion 226 is formed between the main body 221 and the fastening portion 224. The handle 225 may be pressed by using the elastic portion 226 as a fulcrum to separate the fastening portion 224 from the concealed slide 1. In addition, a positioning hook 227 is installed at a side of the main body 221 and provided for connecting the concealed slide 1. The fastening portion 224 is bent into triangular shape and its end is not coupled to the elastic fastener 22, and a guiding bevel 2241 comes with a negative angle design and is configured to be corresponsive to the concealed slide 1, so that the front connecting device 2 and the concealed slide 1 will not be loosened or separated after they are latched.

Similarly, the level adjusting member 23 is made of an elastic plastic material, and the bottom of the level adjusting member 23 is movably installed into the pivot hole 214, and a second pivot portion 231 is formed at an end of the level adjusting member 23 and configured to be corresponsive to the first pivot portion 223 for connecting the elastic fastener 22, and a lever 232 is installed at the other end of the level adjusting member 23, such that when the lever 232 is adjusted, the concealed slide 2 is aligned precisely opposite to a horizontal position of the drawer 3.

Similarly, the vertical adjusting member 24 is made of an elastic plastic material and movably installed to the vertical socket portion 213, and capable of moving back and forth, and an end of the vertical adjusting member 24 is configured to be corresponsive to the concealed slide 1 and has a ramp 241, such that when the vertical adjusting member 24 is adjusted, the concealed slide 1 is aligned precisely opposite to a vertical position of the drawer 3. It is noteworthy that the front end of the vertical adjusting member 24 has a positioning bump 242 corresponsive to the limit notch 2131, and the vertical adjusting member 24 has a stopper member 243 disposed at the center of the vertical adjusting member 24 and configured to be corresponsive to the serrated positioning plate 2132 for positioning the vertical adjusting member 242 at the position of the vertical socket portion 213, and a socket ring 244 is disposed at the rear end of the vertical adjusting member 24 and configured to be corresponsive to the limit hook 2133, so that the vertical adjusting member 24 can be moved and adjusted smoothly without the risk of falling off.

Figure 4:
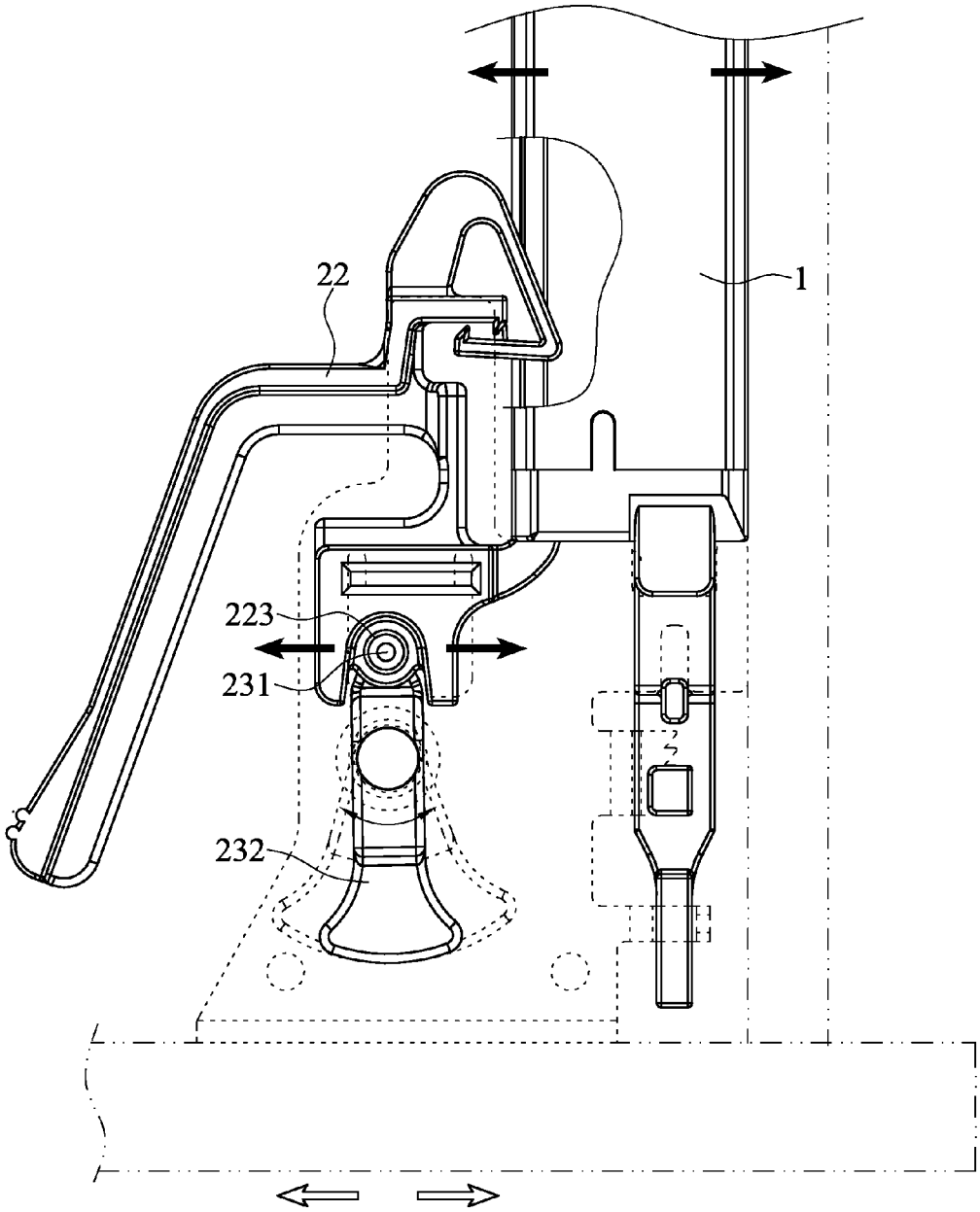
FIG. 4 is a schematic view of the status of making a horizontal adjustment to a front connecting device of a concealed slide in accordance with a preferred embodiment of the present invention.

With reference to FIG. 4 for a schematic view of making a horizontal adjustment of a preferred embodiment of the present invention horizontal, the lever 232 is turned, and the second pivot portion 231 links the first pivot portion 223 to drive the elastic fastener 22 to move in an opposite direction. In other words, when the lever 232 is turned outwardly, the elastic fastener 22 is pushed towards an inner side of the concealed slide 1. On the other hand, when the lever 232 is turned inwardly, the elastic fastener 22 is pushed towards an outer side of the concealed slide 1.

Figure 5:
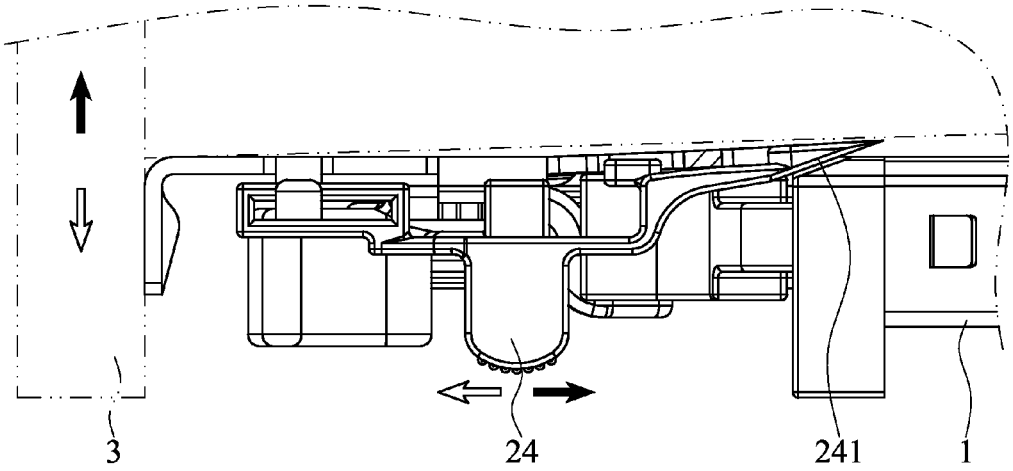
FIG. 5 is a schematic view of the status of making a vertical adjustment to a front connecting device of a concealed slide in accordance with a preferred embodiment of the present invention.

With reference to FIG. 5 for a schematic view of making a vertical adjustment of a preferred embodiment of the present invention vertical, if the vertical adjusting member 24 is pushed forward (in a direction as indicated by the black arrow in the figure), the ramp 241 will be plugged between the drawer 3 and the concealed slide 1, so that the gap between the drawer 3 and the concealed slide 1 becomes bigger. On the other hand, if the ramp 241 is retracted (in a direction as indicated by the white arrow in the figure), the drawer 3 is acted by the gravitational force, so that the gap between the drawer 3 and the concealed slide 1 becomes smaller or may even have no gap at all.

In summation of the description above, the present invention provides a simple, easy, intuitive and convenient operation and improves the convenience of use significantly. In addition, the present invention provides a simple and easy way of repairing or replacing damaged components.

What is claimed is:

1. A front connecting device of a concealed slide, installed to an end of the concealed slide, the other end of the front connecting device being fixed to a drawer for adjusting a horizontal gap and/or a vertical gap of the drawer, and the front connecting device comprising:

a metal base, having a fixing portion formed at an end and fixed to the drawer, a horizontal socket portion and a vertical socket portion erected from the metal base, and a pivot hole formed on a side of the horizontal socket portion;

an elastic fastener, having a main body made of an elastic plastic material, an elongated groove hole and a first pivot portion formed at an end of the elastic fastener, and the elastic fastener passing through the elongated groove hole and movably installed into the horizontal socket portion, and a fastening portion formed at an end of the elastic fastener and connected from a side and fixed to the concealed slide, a handle extended along a side of the fastening portion, and an elastic portion disposed between the main body and the fastening portion, such that the handle may be pressed to deform the elastic portion in order to separate the fastening portion from the concealed slide, and a positioning hook being installed to a side of the main body and provided for connecting the concealed slide;

a level adjusting member, with the bottom movably installed into the pivot hole, and having a second pivot portion disposed at an end of the level adjusting member and configured corresponsive to the first pivot portion and provided for connecting the elastic fastener, and a lever installed at the other end of the level adjusting member, such that when the lever is adjusted, the concealed slide is aligned precisely opposite to a horizontal position of drawer; and a vertical adjusting member, movably installed to the vertical socket portion and capable of moving back and forth, and having a ramp formed at an end of the vertical adjusting member and configured to be corresponsive to the concealed slide, such that when the vertical adjusting member is adjusted, the concealed slide is aligned precisely opposite to a vertical position of the drawer.

2. The front connecting device of a concealed slide as claimed in claim 1, wherein the metal base is formed by stamping a metal sheet, and the fixing portion is a vertically bent edge of the metal sheet and has at least two fixing holes.

3. The front connecting device of a concealed slide as claimed in claim 2, wherein the vertical socket portion includes a limit notch, a serrated positioning plate and a limit hook, and the vertical adjusting member includes a positioning bump formed at a front end of the vertical adjusting member and configured to be corresponsive to the limit notch, a stopper member disposed at the center of the vertical adjusting member and configured to be corresponsive to the serrated positioning plate for positioning the vertical adjusting member at a position of the vertical socket portion, and a socket ring disposed at a rear end of the vertical adjusting member and configured corresponsive to the limit hook.

4. The front connecting device of a concealed slide as claimed in claim 3, wherein the fastening portion is bent into a triangular shape, and an end of the fastening portion is not coupled to the elastic fastener.

5. The front connecting device of a concealed slide as claimed in claim 4, wherein the fastening portion has a guiding bevel configured to be corresponsive to the concealed slide.

* * * * *